US005470239A

United States Patent [19]

Rancourt

[11] Patent Number: 5,470,239

[45] Date of Patent: Nov. 28, 1995

[54] INTERNATIONAL ELECTRICAL GROUND CONNECTOR-ADAPTOR FOR COMPUTER MONITOR

[75] Inventor: James D. Rancourt, Santa Rosa, Calif.

[73] Assignee: Optical Coating Laboratory, Inc., Santa Rosa, Calif.

[21] Appl. No.: 35,446

[22] Filed: Mar. 23, 1993

[51] Int. Cl.[6] ..... H01R 4/66

[52] U.S. Cl. ..... 439/105; 439/654; 439/639

[58] Field of Search ..... 439/96, 105, 100, 439/108, 651, 654, 639

[56] References Cited

U.S. PATENT DOCUMENTS 4,173,383 11/1979 Lee ..... 439/105

4,725,240 11/1988 Braverman ..... 439/105

*Primary Examiner*—David L. Pirlot

*Attorney, Agent, or Firm*—Philip A. Dalton

[57] ABSTRACT

A power connector in accordance with IEC320 for providing common connections for individual male and female connectors and a ground lead, for example, to a anti-glare filter. The power connector device includes an insulating body which houses male ground and power plugs and female ground and power receptacles which are joined within the body to the male plugs; a common ground connector adapted for external connection to a ground lead as well as to the electrically common male and female ground connectors; and preferably a shroud surrounding the external sections of the male plugs for preventing accidental human contact.

8 Claims, 2 Drawing Sheets

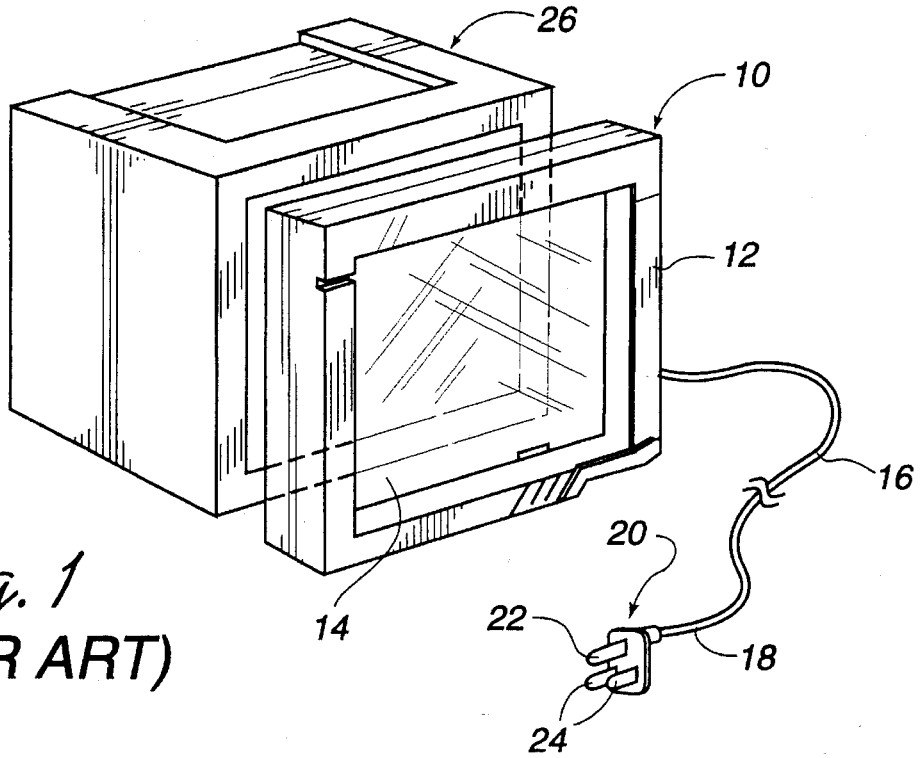
Fig. 1
(PRIOR ART)
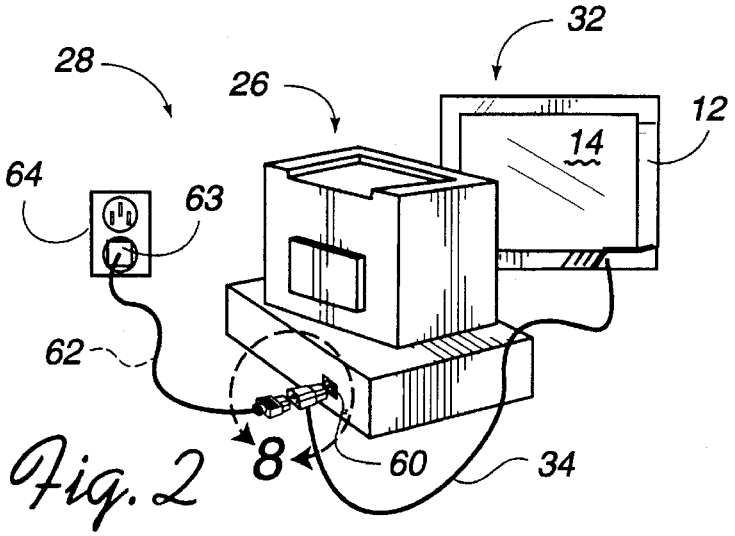
Fig. 2
Fig. 8
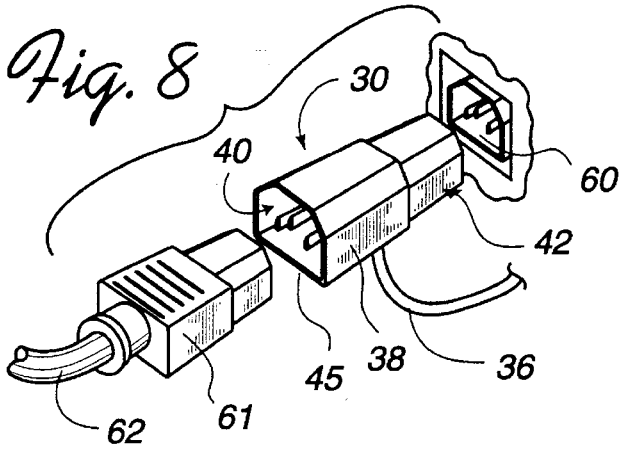

INTERNATIONAL ELECTRICAL GROUND CONNECTOR-ADAPTOR FOR COMPUTER MONITOR

BACKGROUND OF THE INVENTION

The present invention relates to electrical ground connections for CRT (cathode ray tube) monitors and other VDTs (video display terminals) and, in particular, to ground connections for contrast enhancement filters such as the GLARE/GUARD® anti-glare filters used on VDTs.

DESCRIPTION OF THE RELEVANT TECHNOLOGY

Typically, ground connections for the contrast enhancement filters used in association with cathode ray tubes and other video display terminals comprise, in the U.S., a cord adapted for attachment to a 3-prong AC electrical outlet and, elsewhere, an alligator clip termination. These arrangements suffer from several problems. For example, a convenient grounding location may not be available. Also, the cord may not be connected or may be inadvertently disconnected, leading to an electrical shock hazard.

Referring to FIG. 1, perhaps the most convenient prior art ground connection arrangement-one which does not suffer from the above disadvantages-is that used in the GLARE/GUARD® anti-glare filter available from assignee. The GLARE/GUARD® filter 10 comprises a bezel 12 which is adapted for mounting over the monitor or screen of tile CRT monitor 26. The bezel 12 mounts an optically transparent plate or panel 14, which may have absorbing characteristics and has conductive, optical control thin film coatings (not shown) formed on one or both major surfaces, for example, for reducing glare. A long ground lead 16 is attached at one end to the filter, in electrical contact with the conductive coating(s). The free end 18 of the ground lead incorporates a male 3-prong electrical plug 20 which is designed for insertion into a standard 3-prong power receptacle or socket. The plug 20 comprises a conducting grounding pin 22 connected to the ground lead and two "dummy" prongs 24. As mentioned, the GLARE/GUARD® filter 10 does not suffer from the above-mentioned disadvantages of other prior art devices. However, despite its utility and advantages, like all things made by man, the GLARE/GUARD® filter can be improved. Specifically, the ground-only dummy plug 20 occupies an electrical outlet and prevents the outlet from being used for its intended purpose of supplying electrical energy. This may be an inconvenience in computer installations where multiple devices need to be connected to a power source.

SUMMARY OF THE INVENTION

In one aspect, my invention is embodied in a power connector comprising an insulating body which houses electrically common male and female external receptacles, including a common ground connector; and an external ground line electrically joined to the ground connector. The ground line may be permanently joined to the ground connector or may be detachable. The power connector is readily implemented in configurations which comply with international standard IEC320.

In another aspect, my invention is embodied in a power connector for attaching a ground line to an electrical outlet, comprising an insulating body having receptacle means which comprises three sockets including a ground socket located at one side of the body, and plug means which comprises three associated prongs including a ground prong extending from another side of the body. Also, means is provided for electrically connecting the three sockets to associated ones of the prongs, including connecting the ground socket to the ground prong, to provide electrical through-connectors, including a ground connector; and means is provided for connecting the ground line to the ground connector. Thus, when an external plug is connected to the receptacle means and an external receptacle is connected to the plug means, the through-connectors electrically connect the external plug and receptacle, providing through-connections for the power and ground conductors, including the ground line.

BRIEF DESCRIPTION OF THE DRAWING

The above and other aspects of my invention are described below with respect to the drawing, in which:

FIG. 1 is a simplified exploded perspective view of a GLARE/GUARD® anti-glare filter and an associated video display terminal.

FIG. 2 is a simplified perspective view of one preferred contrast enhancement filter incorporating an electrical ground connector-adaptor embodying my invention.

FIG. 8 is an enlarged perspective view of a portion of FIG. 2 depicting the power cord-to-ground connector adaptor-to-power receptacle connections.

Figure 5:
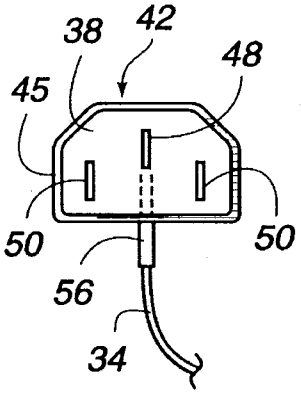
FIGS. 3, 4 and 5 are socket end elevation, side elevation, and prong end elevation views, respectively, of an embodiment of my electrical ground connector-adaptor of FIG. 2 which includes a fixed or integral arrangement for connecting the contrast enhancement filter's ground lead/line to the connector-adaptor.

DETAILED DESCRIPTION OF THE PREFERRED EMBODIMENT a) Connector-Adaptor Construction and Use Please note, for convenience, the word "receptacle" is used generically to include female and male connectors, that is, receptacles and plugs, and specifically, to cover female connectors.

Referring to FIGS. 2 and 8, there is shown a simplified perspective view of a contrast enhancement filter arrangement 28 which incorporates an electrical ground connector-adaptor 30 embodyiny my invention. Preferably, the exemplary filter 32 is a modification of the above-mentioned GLARE/GUARD® filter 10, FIG. 1, which as mentioned comprises a bezel 12 which mounts an optically transparent plate or panel 14 having conductive, optical control thin film coatings formed on one or both major surfaces thereof. According to my modification, ground line or lead 34, which is attached at one end to the filter 10, in electrical contact with the conductive coating(s), is also connected, at its opposite, free end 36 to the ground connector-adaptor 30. Please note, my invention includes (1) the connector-adaptor 30 and (2) the assembly 28 of the connector-adaptor and the associated contrast-enhancement filter, as well as the method of using (1) the connector-adaptor and (2) the connector-adaptor and filter assembly.

Figure 3:
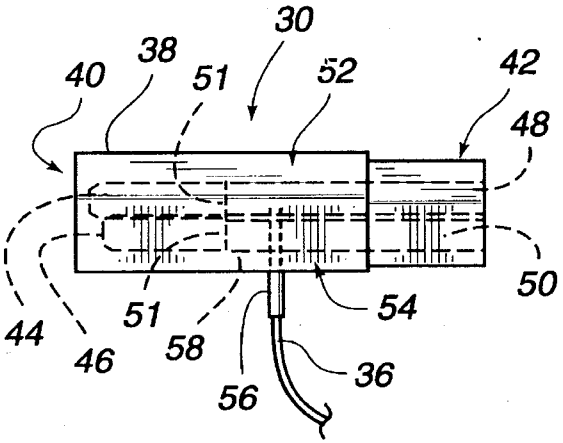
Figure 4:
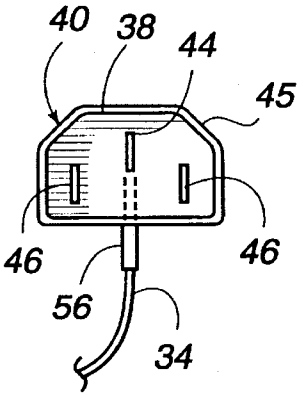

Referring further to FIGS. 2 and 8 as well as to the embodiment 30 of my connector-adaptor shown in FIGS. 3, 4 and 5, the connector-adaptor comprises an insulating body 38 of material such as molded plastic. A 3-socket conductive female receptacle 42 and a 3-prong male plug 40 are embedded in and extend from opposite ends or sides of the body 38. The receptacle 42, FIG. 5, preferably comprises an IEC320 standard 3-socket female arrangement of ground socket 48 and two power sockets 50—50. Similarly, the plug 40, FIG. 4, preferably comprises an IEC320 standard 3-prong male arrangement of ground prong 44 and two power prongs 46—46. The prongs and associated sockets are joined electrically, for example, by forming the sockets and prongs integrally, by soldering along junctions 51—51, FIG. 3, by inserting the prongs into the sockets using a friction fit arrangement, optionally assisted by soldering, etc., or by any of the various mounting and joining techniques which are well known to those of usual skill in the art. In a standard IEC320 configuration, the three prongs are laterally surrounded and covered by a single shroud 45 to prevent direct contact with the energized prongs when they are inserted in a socket. The shroud 45 may be attached to the plug body 38 or, preferably, formed integrally with the plug body.

The resulting device 30 comprises direct-coupled male-female connectors in a unitary molded body. That is, each of the two power-carrying conductors 54—54, FIG. 3, is formed by the joined power socket 50 and power prong 46. The ground conductor 52, FIG. 3, is formed by the joined ground socket 48 and ground prong 44. Also, the ground conductor has provision for an external connection, illustratively a conductor terminal 56 which extends from one side 58 of the insulator body 38 and is integrally formed with or joined to the ground conductor 52, typically in a "T" configuration. In the FIGS. 3–5 embodiment, the conductor terminal 56 is permanently joined to (or is formed integrally with) the free end 36 of the ground lead 34.

In use, and referring further to FIGS. 2–5, the connector-adaptor 30 is plugged into the external power socket 60 at the rear of the CRT 26. Then, one end 61 of the CRT power cord 62 is plugged into the connector-adaptor 30 and the opposite end 63 is plugged into the utility mains, for example, into a wall or floor receptacle 64.

Figure 7:
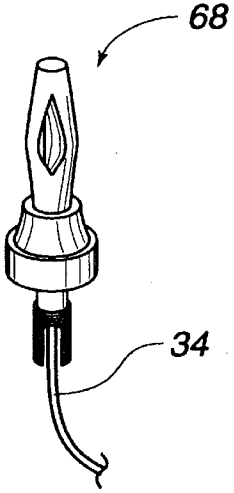
FIG. 7 depicts a banana-type pin which is suitable for use in the removable pin embodiment of FIG. 6.
Figure 6:
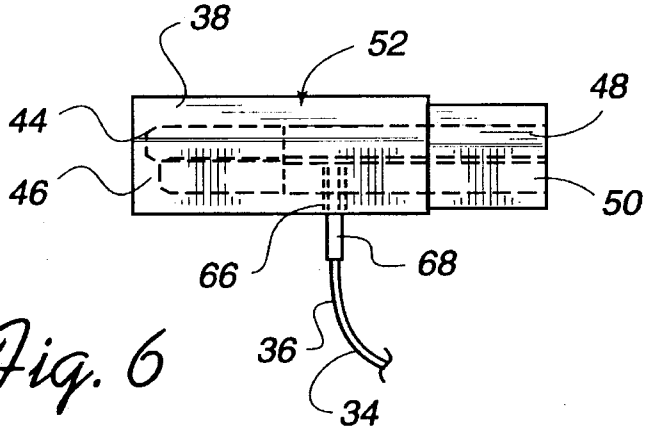
FIG. 6 depicts a side elevation view of an alternative, removable pin arrangement for connecting the contrast enhancement filter's ground lead to the connector-adaptor.

Referring to FIG. 6, alternatively to the permanent/integral connector-adaptor and ground lead arrangement shown in FIGS. 3–5, the ground lead 32 may be detachable from the connector-adaptor 30. In an exemplary detachable arrangement, the connector-adaptor 30 includes a conductive socket 66 which is connected electrically to the ground conductor 52. The end 36 of the ground lead 34 terminates in a mating pin or plug 58 which is designed for secure, readily detachable connection to the socket 66. FIG. 7 illustrates a commercially available banana plug, which is one of several suitable removable plugs 68.

b) Summary of Certain Advantages of My Connector-Adaptor

A number of the advantages of my connector-adaptor invention are discussed above and/or are apparent from the above discussion. The advantages include providing common filter ground and monitor ground and power connections by plugging the connector-adaptor 30 into the power receptacle 60 of a monitor, or computer or other appliance which preferably has an IEC320 compatible connection, and plugging the power cord 62 for the monitor into the connector-adaptor. This arrangement also provides a short path from the filter 12 to chassis or other ground. In addition, because prior art alligator clip ground connections are made unnecessary, my invention eliminates the need for a separate grounding location, and decreases or eliminates the possibility of the ground cord unit being unconnected or being inadvertently disconnected. (Please note, in recent products, appropriate conductive ground points are avoided by design, thus causing the user difficulty in finding a ground point.) Finally, but not exhaustively, my invention eliminates the need for and use of a ground-only dummy plug such as 20, FIG. 1, thus freeing the electrical power outlets for their intended use.

Based upon the above disclosure of preferred and alternative embodiments of my invention, those of usual skill in the art will readily derive alternatives and implement modifications which are equivalent to my invention and within the scope of the following claims. As mentioned above, the word "receptacle" is used generically to include female and male connectors, that is, receptacles and plugs, and specifically, to cover female receptacle and connectors.

I claim:

1. A power connector comprising: an insulating body; electrically interconnected male and female external receptacles mounted in the insulating body, for connecting a first device to a power electrical outlet, each receptacle including a pair of power connectors and a ground connector, and the individual power and ground connectors of the male receptacle being permanently connected to associated power and ground connectors of the female receptacle; an external ground line adapted for connection to a second device separate from the power electrical outlet; means for connecting the external ground line to the electrically interconnected ground connector of the male and female external receptacles, thereby connecting the second device to a ground connection of the electrical outlet via the electrically interconnected ground connectors of the male and female receptacles; and wherein the means for connecting the ground line to the ground connector comprises a socket housed in the body and a mating prong mounted on the ground line for removable insertion into the ground connector socket.

2. The power connector of claim 1, wherein the ground line prong is a banana prong.

3. A grounded contrast enhancement filter device for a display, adapted for providing ground connection to the filter and ground and power connections to the display, comprising: a contrast enhancement filter; a ground lead connected to the filter; and a power connector, comprising an insulating body including receptacle means comprising three sockets including a ground socket located at one side of the body and plug means including three prongs including a ground prong extending from another side of the body; means electrically individually connecting the three sockets to associated ones of the prongs, including connecting the ground socket to the ground prong, to provide electrical through-connectors, including a ground connector, for electrically connecting an external plug connected to the receptacle means of the power connector through the power connector to an external receptacle connected to the plug means; and means for connecting the ground line to the ground connector of the power connector; whereby the power connector receptacle means or plug means may be connected to the power plug or receptacle of a display and a power cord may be connected to the plug means or receptacle means, thereby simultaneously providing power and ground connections to the display and ground connection to the filter.

4. The device of claim 3, wherein the means for connecting the ground line to the ground connector provides permanent connection.

5. The device of claim 3, wherein the means for connecting the ground line to the ground connector provides removable connection.

6. The device of claim 3, wherein the means for connecting the ground line to the ground connector comprises a socket housed in the body and a mating prong mounted on the ground line for removable insertion into the ground connector socket.

7. The device of claim 6, wherein the ground line prong is a banana prong.

8. The device of any one of claims 1, 2 or 3–7, further comprising a shroud mounted to the insulating body and extending laterally over the male receptacles or prongs, for preventing accidental human contact with the prongs.

* * * * *